US007794268B2

(12) United States Patent
Breen, IV et al.

(10) Patent No.: US 7,794,268 B2
(45) Date of Patent: Sep. 14, 2010

(54) IN-LINE PUSH-IN WIRE CONNECTOR

(75) Inventors: Dennis M. Breen, IV, West Chicago, IL (US); Sushil N. Keswani, Sycamore, IL (US)

(73) Assignee: IDEAL Industries, Inc., Sycamore, IL (US)

( * ) Notice: Subject to any disclaimer, the term of this patent is extended or adjusted under 35 U.S.C. 154(b) by 0 days.

(21) Appl. No.: 12/437,707

(22) Filed: May 8, 2009

(65) Prior Publication Data

US 2009/0215326 A1 Aug. 27, 2009

Related U.S. Application Data

(63) Continuation-in-part of application No. 12/167,854, filed on Jul. 3, 2008, now Pat. No. 7,722,384.

(60) Provisional application No. 60/948,585, filed on Jul. 9, 2007.

(51) Int. Cl.
*H01R 4/48* (2006.01)

(52) U.S. Cl. ..... 439/441; 439/439; 439/787

(58) Field of Classification Search ..... 439/441, 439/439, 787

See application file for complete search history.

(56) References Cited

U.S. PATENT DOCUMENTS

| | | | |
|---|---|---|---|
| 2,359,541 | A | 10/1944 | Bancroft |
| 2,816,193 | A | 12/1957 | Pine |
| 2,920,163 | A | 1/1960 | Johnson |
| 3,324,447 | A | 6/1967 | Pistey |
| 3,646,582 | A | 2/1972 | Van Alphen et al. |
| 3,936,126 | A | 2/1976 | Miller |
| 3,945,711 | A | 3/1976 | Hohorst et al. |
| 4,133,595 | A | 1/1979 | Pritulsky |
| 4,179,583 | A | 12/1979 | Sergev |
| 4,273,402 | A | 6/1981 | Hughes |
| 4,731,033 | A | 3/1988 | Bajohr et al. |
| 4,952,167 | A | 8/1990 | Hertelendy |
| 4,973,263 | A | 11/1990 | Nielsen |
| 5,158,475 | A | 10/1992 | Tyler |
| 5,263,878 | A | 11/1993 | Lai |
| 5,975,940 | A | 11/1999 | Hartmann et al. |
| 6,039,597 | A | 3/2000 | Getselis et al. |
| 6,093,052 | A | 7/2000 | Wang |
| 6,132,238 | A | 10/2000 | Hartmann et al. |
| 6,250,950 | B1 | 6/2001 | Pallai |
| 6,257,919 | B1 | 7/2001 | Cutler et al. |
| 6,746,286 | B2 | 6/2004 | Blaha |
| 7,150,646 | B2 | 12/2006 | Trumper |
| 7,281,942 | B2 | 10/2007 | Swedberg et al. |
| 7,384,319 | B2 | 6/2008 | Kirstein et al. |
| 7,670,197 | B2 * | 3/2010 | Janulis et al. ..... 439/787 |

FOREIGN PATENT DOCUMENTS

DE 3743410 6/1989

* cited by examiner

*Primary Examiner*—Gary F. Paumen
(74) *Attorney, Agent, or Firm*—Cook Alex Ltd.

(57) ABSTRACT

A push-in wire connector has an enclosure that includes at least two wire entry ports that face in opposite directions. A terminal assembly is disposed within the enclosure and includes a busbar positioned between the wire ports. A spring member biases inserted conductors into engagement with the busbar.

24 Claims, 15 Drawing Sheets

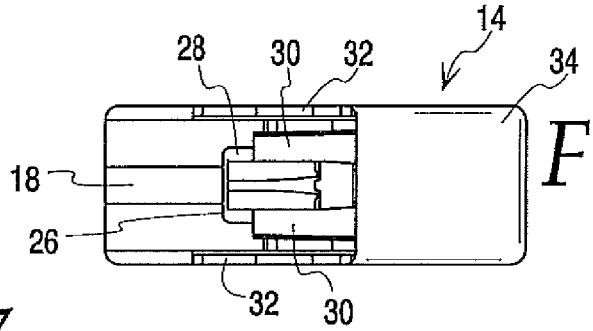
Fig. 4
Fig. 7
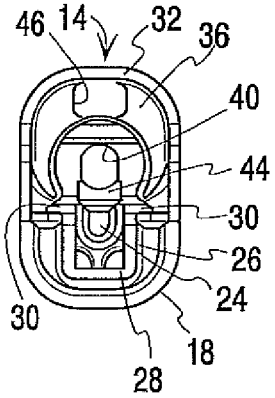
Fig. 3
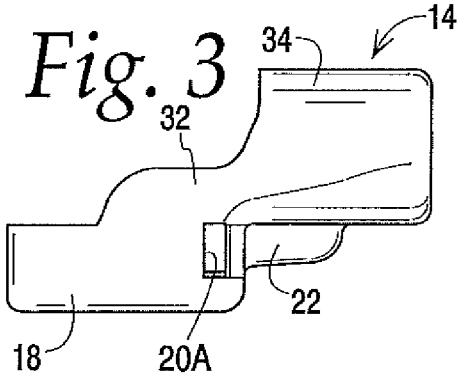
Fig. 6
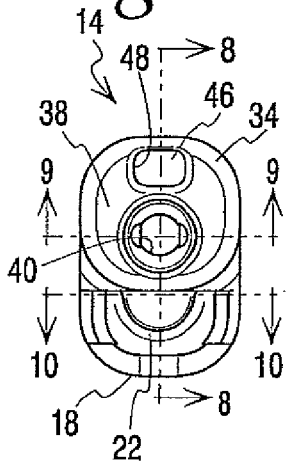
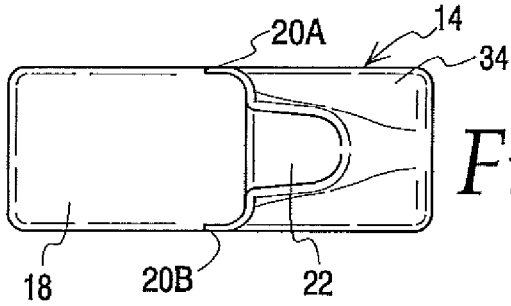
Fig. 5
Fig. 10
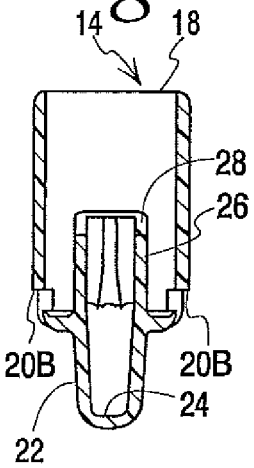
Fig. 8
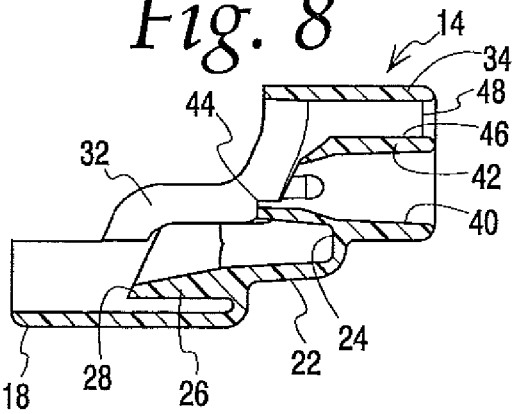
Fig. 9
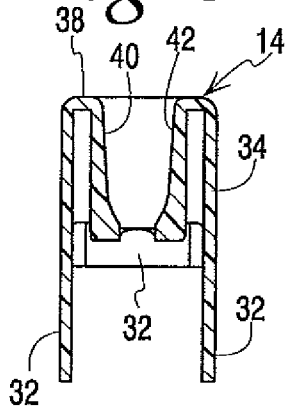

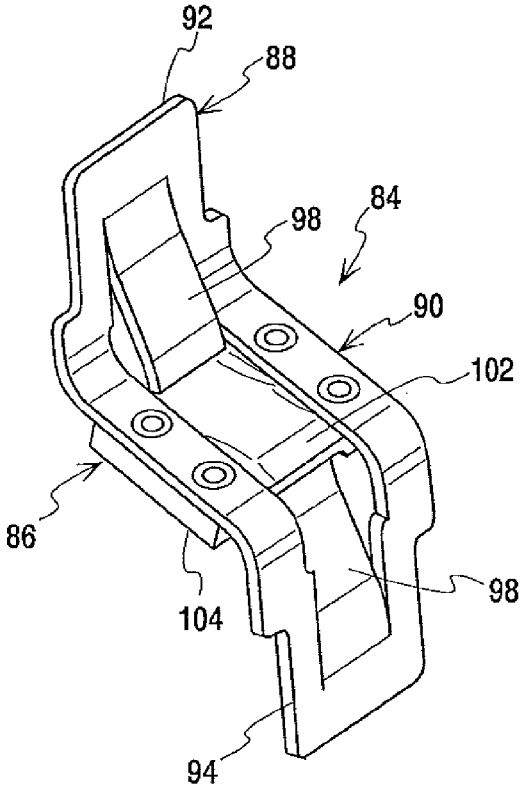
Fig. 20
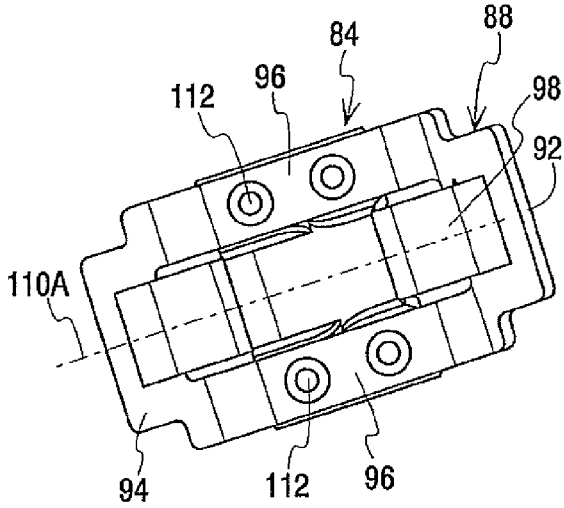
Fig. 23
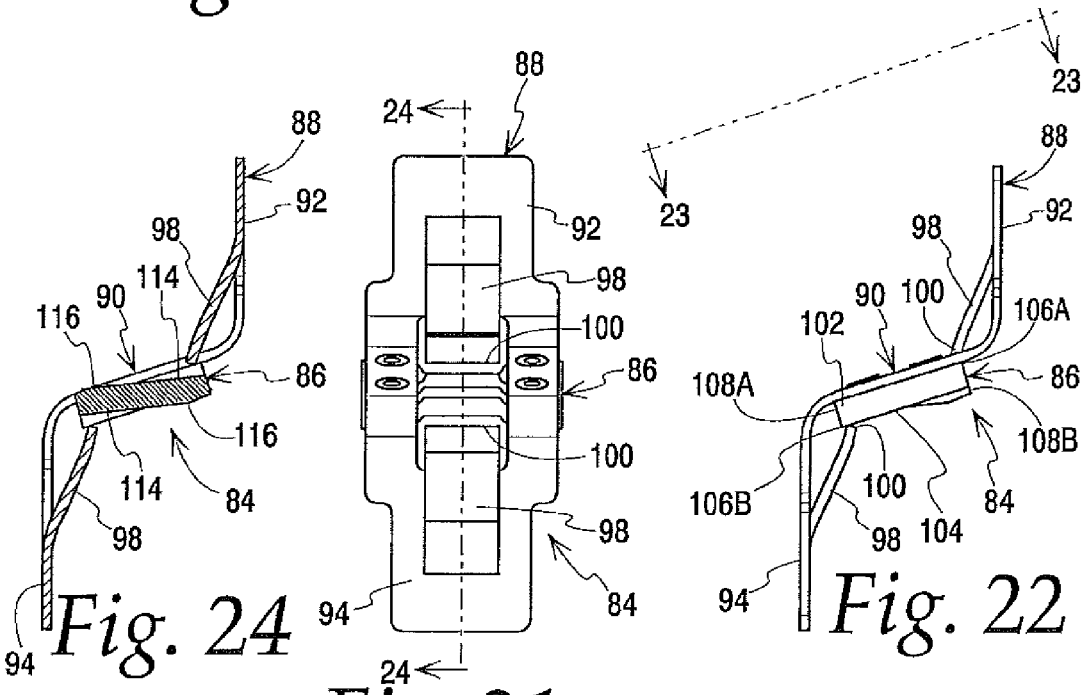
Fig. 24
Fig. 21
Fig. 22

IN-LINE PUSH-IN WIRE CONNECTOR

CROSS-REFERENCE TO RELATED APPLICATION

This application is a continuation-in-part application of U.S. Utility application Ser. No. 12/167,854, filed Jul. 3, 2008, and further claims the benefit of U.S. Provisional Application No. 60/948,585, filed Jul. 9, 2007, the disclosures of both of which are hereby incorporated herein by reference.

BACKGROUND OF THE INVENTION

This invention relates to push-in wire connectors. Push-in connectors operate, as the name implies, by simply pushing a stripped end of two or more wires or conductors into the connector. Once the wires are pushed into the connector no closing, crimping, twisting, insulation displacement or other manipulation of the connector is required to finish the connection, making the push-in connector advantageous from the standpoint of time needed to install it. The push-in connector must perform several tasks including electrically isolating its conductors from the surrounding environment, retaining the conductors in the connector, and providing good electrical conductivity between the conductors.

The electrical isolation function is typically performed by a housing made of electrically insulating material. The housing has a generally hollow interior. Openings in the housing provide access to the interior for the stripped ends of two or more electrical conductors. Once inside the housing the bared ends of the conductors are fully surrounded by the insulating housing.

The function of providing electrical conductivity is performed by an electrically-conductive shorting member. The shorting member, often called a busbar, is inside the housing and is disposed so as to be engageable with all conductors inserted into the housing. The shorting member provides a conductive path between all inserted conductors. Since the primary job of the busbar is conduction, it is typically made of a highly conductive material such as copper or tin-plated copper. But even a highly conductive busbar will not provide good conductivity between conductors if those conductors are not held firmly in contact with the busbar. Thus it is common to include a spring member which works in concert with the busbar to hold the conductors firmly against the busbar. Various arrangements of the spring member are possible, including building it into the housing, building it into the busbar, or making it a separate component in the interior of the housing. In any case, the spring member urges all conductors into solid mechanical and electrical engagement with the shorting member.

The function of holding the conductors in the housing is performed by a retention member that engages the ends of the inserted conductors and prevents axial retraction from the housing. As in the case of the spring member, the retention member could be built into the housing. Alternately, the retention member and spring member can be configured as a combined unit inside the housing. In either case the retention member grasps the conductors and prevents unintentional removal of the conductors from the housing. In some embodiments the retention member is releasable so that conductors may be selectively removed from the housing without damage to any of the components. In other embodiments where it is desired that the conductors not be removed from the connector under any circumstances the retention member is intentionally made to be non-releasable.

As just mentioned, the retention member is often configured in combination with the spring member to apply a force that urges the inserted conductor into contact with the shorting member and prevents retraction of the conductor. A common configuration is to have a resilient metal retention member having spring fingers formed therein. As a conductor is inserted into the housing it engages a spring finger and causes it to flex away from its rest position. The resulting deflection of the spring finger generates a compressive force on the conductor that presses it into solid contact with the busbar. The spring finger is angled to permit insertion of the conductor past the finger in one direction but withdrawal of the conductor in the opposite direction is not permitted due to the self-locking configuration of the spring finger. Thus, engagement of the spring finger with the conductor provides the dual functions of pressing the conductor into the busbar and preventing withdrawal of the conductor from the housing.

The pressing of the conductor into the busbar, of course, requires a stable structure for resisting the compressive force of the spring finger. While firm support for the busbar can be provided either by the spring member or the housing, or both, a problem can arise when the connector is used with stranded wire. Stranded wire tends to flatten out or splay when subjected to the compressive force of the spring finger. Since the compressive and resistive forces of the spring finger are only created upon deflection of the spring finger, the splaying of the stranded wire reduces or even eliminates this deflection which can then defeat the dual purpose of the spring finger. The present invention can include features to address this problem.

Another problem with some conventional push-in wire connectors is that while they are arranged to receive various numbers of wires, the connector housings are arranged to receive all incoming wires from the same direction. In other words, the openings in the connector housings all face the same way. If there are wires approaching the connector from opposite directions, the ends of at least some of them have to be bent back 180° to enable the wire to enter the connector. This requires additional time to install the connector. U.S. Pat. No. 6,132,238 is an example of this type of connector. However, U.S. Pat. Nos. 6,093,052 and 4,133,595 are examples of connectors that have wire ports facing different directions.

Other problems with existing push-in connectors include the fact that they tend to be rather bulky. This makes them more difficult to install in tight quarters. It also uses extra material in manufacture, thereby raising costs. A related problem is the amount of comparatively costly metals used in prior art push-in connectors. Some connectors have complicated contacts or terminals therein made of copper and the like. These contacts are often made from blanks by making multiple folds or bends, sometimes leading to overlapping layers of material. The blanks themselves have complex shapes that require stamping from sheets in a manner that leads to excessive generation of scrap. Many of these contact designs are wasteful of these materials, thereby needlessly increasing the overall cost of the connector.

SUMMARY OF THE INVENTION

The present invention concerns a push-in wire connector having an improved enclosure made of left and right housings which are joined together. Each housing has a port facing one direction and a wire-receiving receptacle box facing in a different direction. Each wire-receiving receptacle box is aligned with the wire port of the opposite housing and thus faces in a different direction from the wire entry port of its housing.

A terminal assembly is mounted in the enclosure. The terminal assembly includes a spring attached to or integrally formed with a busbar. The spring has spring fingers on opposite sides of the busbar. The spring fingers are aligned with respective wire ports and engage conductors inserted into the enclosure to urge them into contact with the busbar. The busbar or central portion of the terminal assembly has a top face and a bottom face. The top face and bottom face also each define an entry edge, an exit edge, and at least one wire-crossing axis extending from the entry edge to the exit edge. The entry edges of the top and bottom faces are on opposite sides of the busbar.

The wires entering the connector through opposing ports overlap to permit the shortest possible enclosure. The terminal design permits efficient use of metal materials, thereby minimizing the cost of the connector. The busbar is disposed at an angle of about 17-degrees to the axis of the wire entry ports. Thus, the busbar somewhat interferes with the path of the wire to create a bump/angled surface for the wire to pass over as the spring member presses the wire into the bump or angled surface.

BRIEF DESCRIPTION OF THE DRAWINGS

FIG. 3 is a side elevation view of the right housing.

FIG. 4 is a top plan view of the right housing.

FIG. 5 is a bottom plan view of the right housing.

FIG. 6 is a right end elevation view of the right housing.

FIG. 7 is a left end elevation view of the right housing.

FIG. 8 is a section taken along line 8-8 of FIG. 6.

FIG. 9 is a section taken along line 9-9 of FIG. 6.

FIG. 10 is a section taken along line 10-10 of FIG. 6.

FIG. 20 is a perspective view of a terminal assembly.

FIG. 21 is an end elevation view of the terminal assembly of FIG. 20.

FIG. 22 is a side elevation view of the terminal assembly.

FIG. 23 is a view looking along line 23-23 of FIG. 22.

FIG. 24 is a section taking along line 24-24 of FIG. 21.

DETAILED DESCRIPTION OF THE INVENTION

Figure 1:
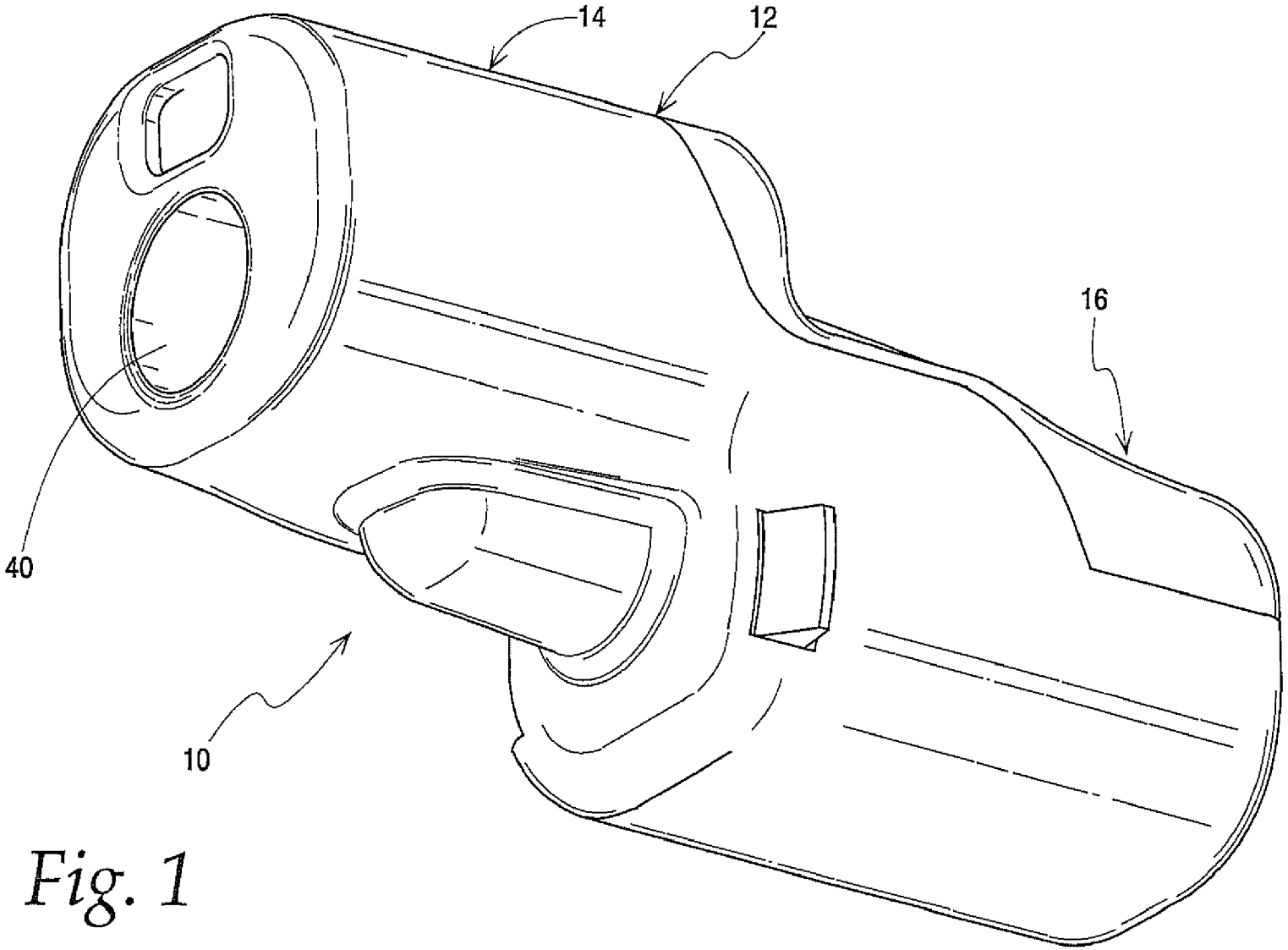
FIG. 1 is a perspective view of the push-in connector of the present invention.

FIG. 1 illustrates the push-in connector 10 of the present invention. The push-in connector has an enclosure shown generally at 12. In this embodiment the enclosure is formed in two pieces and includes a right housing 14 and a left housing 16. Each housing has a wire entry port facing one direction and a wire receptacle box facing the other direction. In this example, an optional test probe opening is formed next to the wire entry port.

Details of the right housing 14 are seen in FIGS. 2-10. As seen in FIG. 3, the housing generally has a lower section at the left which merges with a central section that in turn joins an upper section on the right. The lower section is formed by a generally U-shaped wall 18. Wall 18 is bounded at the central section by locking apertures 20A, 20B. The central section includes a wire receptacle box 22 which has an end wall 24 and a U-shaped guide wall 26. These walls define a hollow chamber which receives the end of a wire inserted into the connector. The guide wall 26 slopes downwardly to the left, as seen in FIG. 8, to help direct an inserted wire into the receptacle box 22. The left end of the guide wall 26 terminates at an angled spring support face 28. The top lands of the guide wall form a pair of laterally-spaced ledges 30. It can be seen in FIG. 8 that the wire receptacle box 22 opens or faces to the left as seen in that figure.

Continuing with FIG. 8, above the guide wall 26 and adjoining both of the top lands of the U-shaped wall 18 there is an S-shaped external flange 32. This flange interfits with a corresponding flange of the left housing, as will be explained below. The flange 32 merges with the upper section that includes a generally oval shell 34. Inside the left end of the shell there is a second spring support face 36, as best seen in FIG. 7. The right end of the shell is covered by an end wall 38. A wire entry port 40 is defined by a wire tube 42. The interior end of the tube 42 is tapered, as shown in FIG. 8, and adjoins a wire support block 44. The wire support block is just above the ledges 30. A test probe opening 46 is defined by a test tube 48 (FIG. 6).

Figure 14:
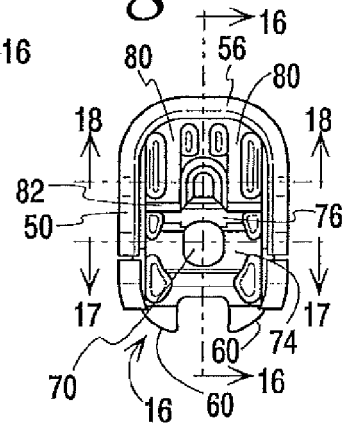
FIG. 14 is a right end elevation view of the left housing.
Figure 17:
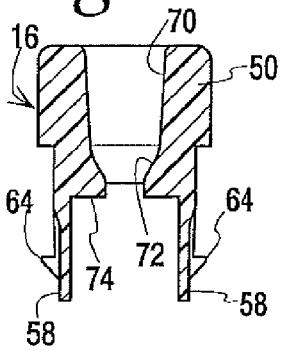
FIG. 17 is a section taken along line 17-17 of FIG. 14.
Figure 13:
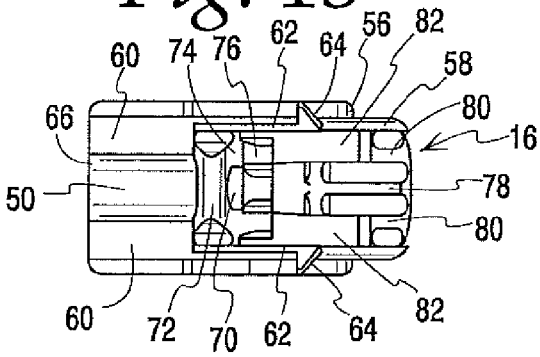
FIG. 13 is a bottom plan view of the left housing.
Figure 18:
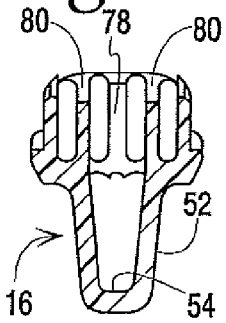
FIG. 18 is a section taken along line 18-18 of FIG. 14.
Figure 16:
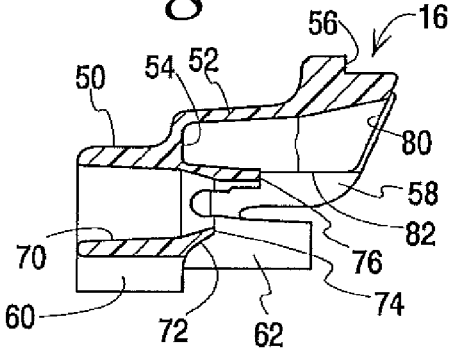
FIG. 16 is a section taken along line 16-16 of FIG. 14.
Figure 19:
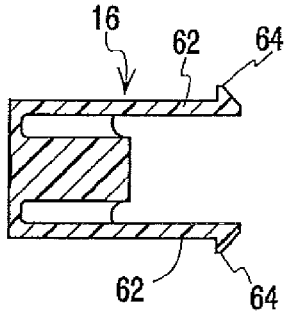
FIG. 19 is a section taken along line 19-19 of FIG. 11.

FIGS. 11-19 illustrate details of the left housing 16. A main body portion 50 has a wire receptacle box 52 protruding upwardly from the body portion. The wire receptacle has an end wall 54 (FIG. 16). An arcuate abutment section 56 extends from the wire receptacle box. An internal flange 58 is attached to the body portion 50 and the abutment section 56. The internal flange is indented somewhat from the outer edges of the body and abutment, as best seen in FIG. 14. The flange is somewhat S-shaped in the side elevation view of FIG. 11 to match the shape of the external flange 32. A curved skirt 60 extends below the body portion. Two arms 62 extend forwardly from the skirt 60. The aims terminate at outwardly facing hooks 64.

When the housings are joined the internal flange 58 fits inside the external flange 32 of the right housing, with the external flange abutting the end faces of the abutment section and the body portion. The skirt 60 and arms 62 fit inside the U-shaped wall 18 of the right housing. The hooks 64 slip into the locking apertures 20A, 20B to engage the ends of wall 18 and hold the two housings together.

A U-shaped cutout 66 (FIG. 15) is defined in an end wall 68 of the main body portion. Just above the cutout 66 is a wire entry port 70 which extends through the main body portion. The interior of the body has a tapered ring at 72 that defines the inner end of the wire port. The right end face of the ring defines a spring support face 74. A wire support block 76 is attached to the upper edge of the tapered ring 72. The wire support block 76, the upper portion of the ring 72, the wire receptacle box 52 and the end wall 54 define a hollow chamber which receives the end of a wire inserted into the connector. Underneath the internal flange there is a central rib 78 and two angled spring support ribs 80. Ribs 80 join ledges 82. The ledges and the wire support block 76 assist in positioning the busbar, as will be described below.

Turning to FIGS. 20-24 a terminal assembly 84 is shown. The terminal assembly comprises a busbar 86 supported on a spring member 88. The spring member includes a foot 90 joined at a first fold line to a first, upstanding leg 92 and at a second fold line to a second, depending leg 94. The foot has a pair of spaced bands 96. The bands have apertures (not shown) for receiving rivets of the busbar as will be described below. Each leg 92, 94 includes a U-shaped slit which defines a spring finger 98. The spring finger is integrally connected to the leg at one end and has a free end 100 at its opposite end. As seen in FIGS. 22 and 24 the spring fingers 98 are bent out of the plane of the legs 92, 94. The free end 100 may be further angled somewhat relative to the remainder of the finger to provide an optimum angle for gripping a wire inserted under the spring finger. The spring member 88 is preferably formed of a resilient metal such as stainless steel.

When installed in the enclosure, the spring finger 98 of leg 92 is opposite the wire entry port 40 so that a wire (conductor) inserted into the right housing will encounter the spring finger and move it upwardly as the wire enters the enclosure. The free end of the spring finger 98 will press on the conductor, preventing it from pulling out of the housing and pushing it into firm engagement with the top face of the busbar 86. Spring finger 98 of leg 94 is similarly situated opposite the wire entry port 70. A wire inserted into the left housing port 70 will encounter spring finger 98 and move it downwardly. The free end of the spring finger 94 will retain the conductor in the enclosure and bias it into engagement with the bottom face of the busbar.

Details of the busbar 86 will be described. The busbar is a generally rectangular member made of tin-plated copper. The busbar defines a thickness between a top face 102 and a bottom face 104. It will be understood that the terms 'top' and 'bottom' are used herein for reference purposes only, as there is nothing inherent in the orientation of the busbar that would make one side or the other of the busbar a top or bottom portion. The top face of the busbar 86 further defines an entry edge 106A, an exit edge 108A, and a wire-crossing axis 110A extending from the entry edge to the exit edge. As used herein the entry edge will be considered the edge of the busbar first crossed by a conductor entering the housing and the exit edge will be considered the edge of the busbar potentially thereafter crossed by an entering conductor. The wire-crossing axis is the location where a conductor will lie, given the construction of the enclosure and the busbar's position in the enclosure. The bottom face of the busbar 86 similarly defines an entry edge 106B, an exit edge 108B, and a wire-crossing axis 110B extending from the entry edge to the exit edge. It will be noted that the entry edges 106A, 106B are on opposite sides of the busbar.

The busbar 86 is attached to the foot 90 of the spring member 88 by means of rivets 112 extending into the apertures of the foot described above. The rivets 112 on the top face 102 may be formed by upsetting a portion of the busbar. It will be understood that other methods for attaching the busbar to the spring member could be used, such as crimping, adhesives or the like. Alternatively, the busbar may not be fixed to the spring at all. Rather, it could be supported by the housing.

As shown in FIGS. 22 and 24, the busbar has a wire-receiving pocket 114 extending from each face and generally aligned with each of the respective wire-crossing axes. There is also a wire-engaging protrusion 116 extending from each face and across each of the respective wire-crossing axes. The pockets 114 and protrusions 116 may be formed by coining the busbar, which creates a pocket on one face and a corresponding protrusion on the other face of the busbar. It can be seen that the pockets 114 and protrusions 116 may be used to form a serpentine path for the conductor to traverse over the face of the busbar. This configuration helps the spring finger 98 retain the conductors in the housing. Depending on the diameter of the conductor, the pockets 114 may surround the conductor at least partially on three sides to prevent splaying of a stranded wire. Further details of this construction are explained in U.S. patent application Ser. No. 11/763,096, filed Jun. 14, 2007, the disclosure of which is incorporated by reference herein.

Figure 2:
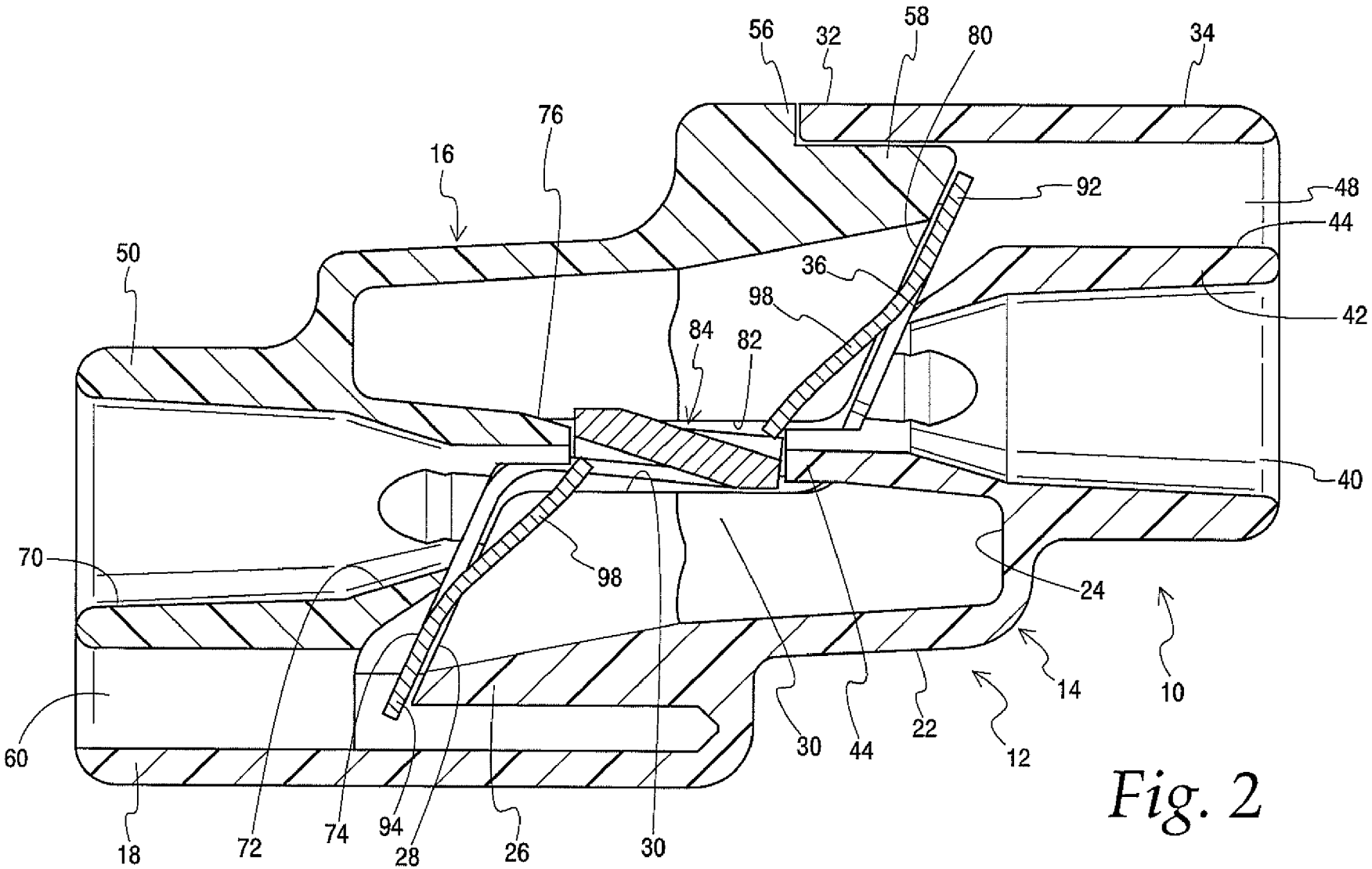
FIG. 2 is a section taken through the longitudinal center of FIG. 1.
Figure 12:
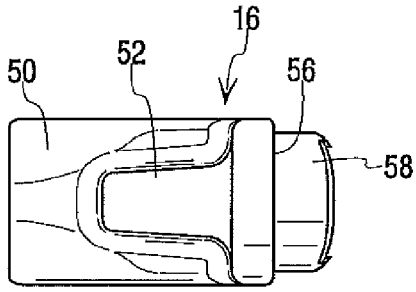
FIG. 12 is a top plan view of the left housing.
Figure 15:
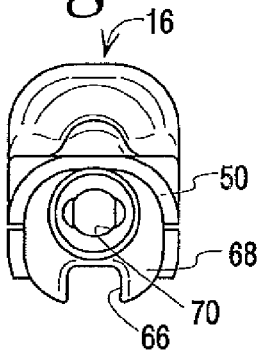
FIG. 15 is a left end elevation view of the left housing.
Figure 11:
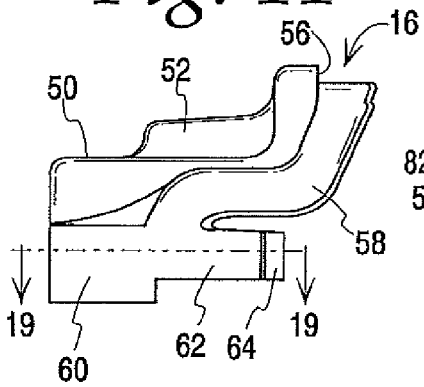
FIG. 11 is a side elevation view of the left housing.

FIG. 2 illustrates the assembled connector and how the parts cooperate. As noted above, the external flange 32 of the right housing fits over the internal flange 58 of the left housing and adjoins the abutment section 56 and body portion 50 of the left housing. The hooks 64 hold the two housings together. The spring member 88 is held fixed between the housings. The busbar 86 is restrained laterally by the support block 76 on the left and the support block 44 on the right. Ledges 82 and 30 engage the busbar to prevent any up or down movement thereof. The upstanding leg 92 of the spring member is trapped between spring support face 36 of the right housing and spring support ribs 80 of the left housing. The depending leg 94 is trapped between the spring support face 28 of the right housing and the spring support face 74 of the left housing.

The use, operation and function of the connector are as follows. The stripped end of a wire is inserted into the wire entry port 40 of the right housing. It encounters the spring finger 98 of leg 92 and pushes the finger upwardly as it continues entry into the enclosure. The end of the conductor enters the wire receptacle box 52 of the left housing, which anchors it in position and prevents splaying of a stranded conductor. The stripped end of a second wire is inserted into the wire entry port 70 of the left housing. It encounters the spring finger 98 of leg 94 and pushes the finger downwardly as the conductor continues entry into the enclosure. The end of the conductor enters the wire receptacle box 22 of the right housing, which anchors it in position and prevents splaying of a stranded conductor.

It will be noted that in this example, the wire entry ports and busbar are arranged such that the busbar is disposed at about a 17° angle to the axes of the wire ports. That is, the busbar is at an angle of about 17° and somewhat interferes with the path of the wire to create a bump/angled surface for the wire to pass over as the spring member presses the wire into the bump or angled surface. This enhances both the holding force of the spring and the electrical contact between the busbar and conductor. The busbar is located adjacent the bottom of port 40 and the top of port 70. Accordingly, the conductors will contact the busbar on opposite sides thereof. This affords an efficient use of the busbar material and allows the conductors to overlap one another lengthwise, enabling a shorter length enclosure. Also, formation of the wire port in one housing and the wire receptacle box in the other housing further contributes to the compact design of the enclosure. The housing construction also permits the elimination of any kind of cap for the back ends, i.e., the wire entry ends, of the housings. This is because the terminal assembly is held between the housings so a separate retention cap is not needed.

Figure 25:
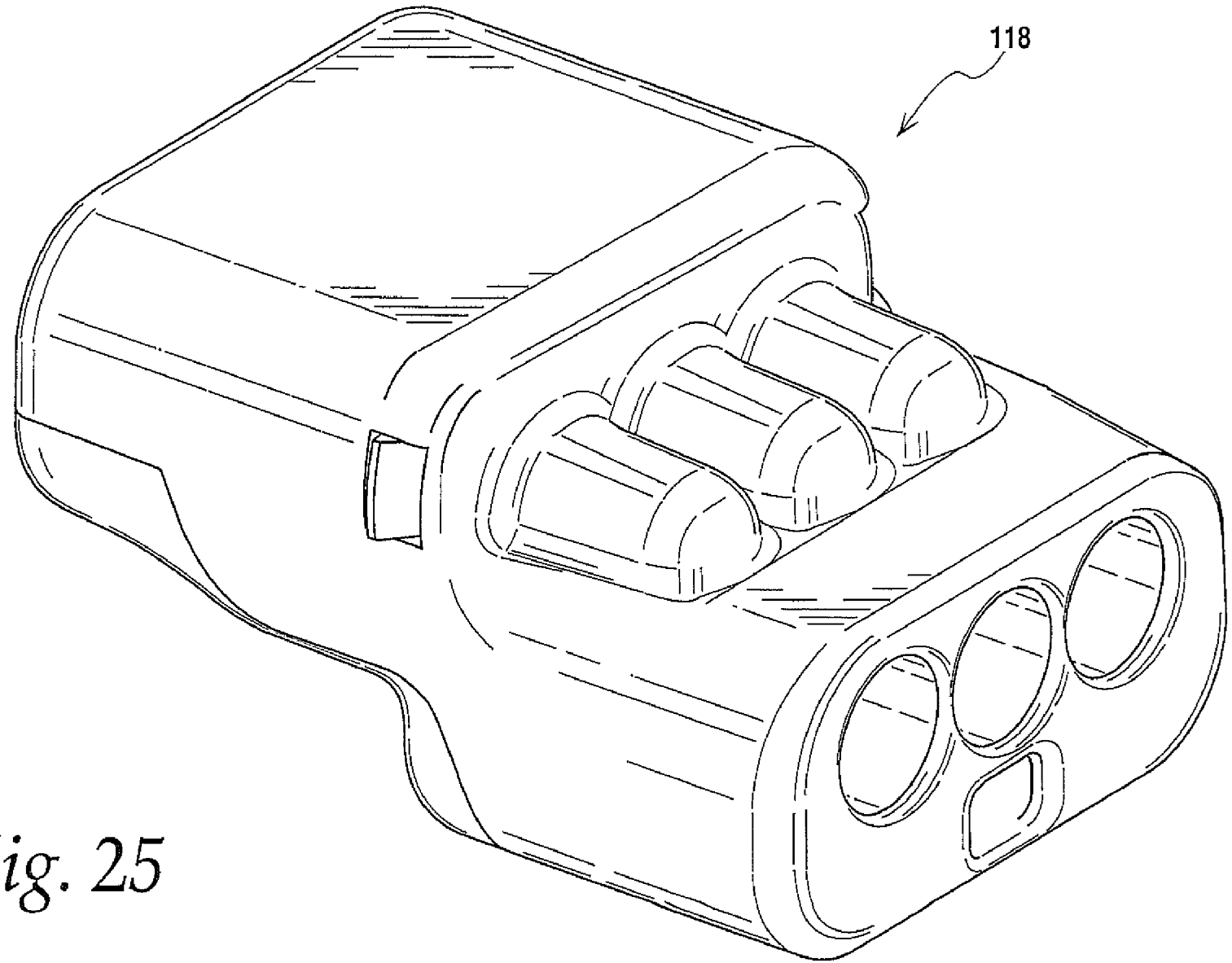
FIG. 25 is a perspective view of an alternate embodiment, which is similar to FIG. 1 but has six wire ports.

FIG. 25 illustrates a six-port version of an in-line push-in connector 118. The housing and terminal construction is essentially the same as in the previous embodiment, with the previous features being duplicated to add two additional wire ports to each housing and two additional spring fingers on both the top and bottom of the spring member.

Figure 26:
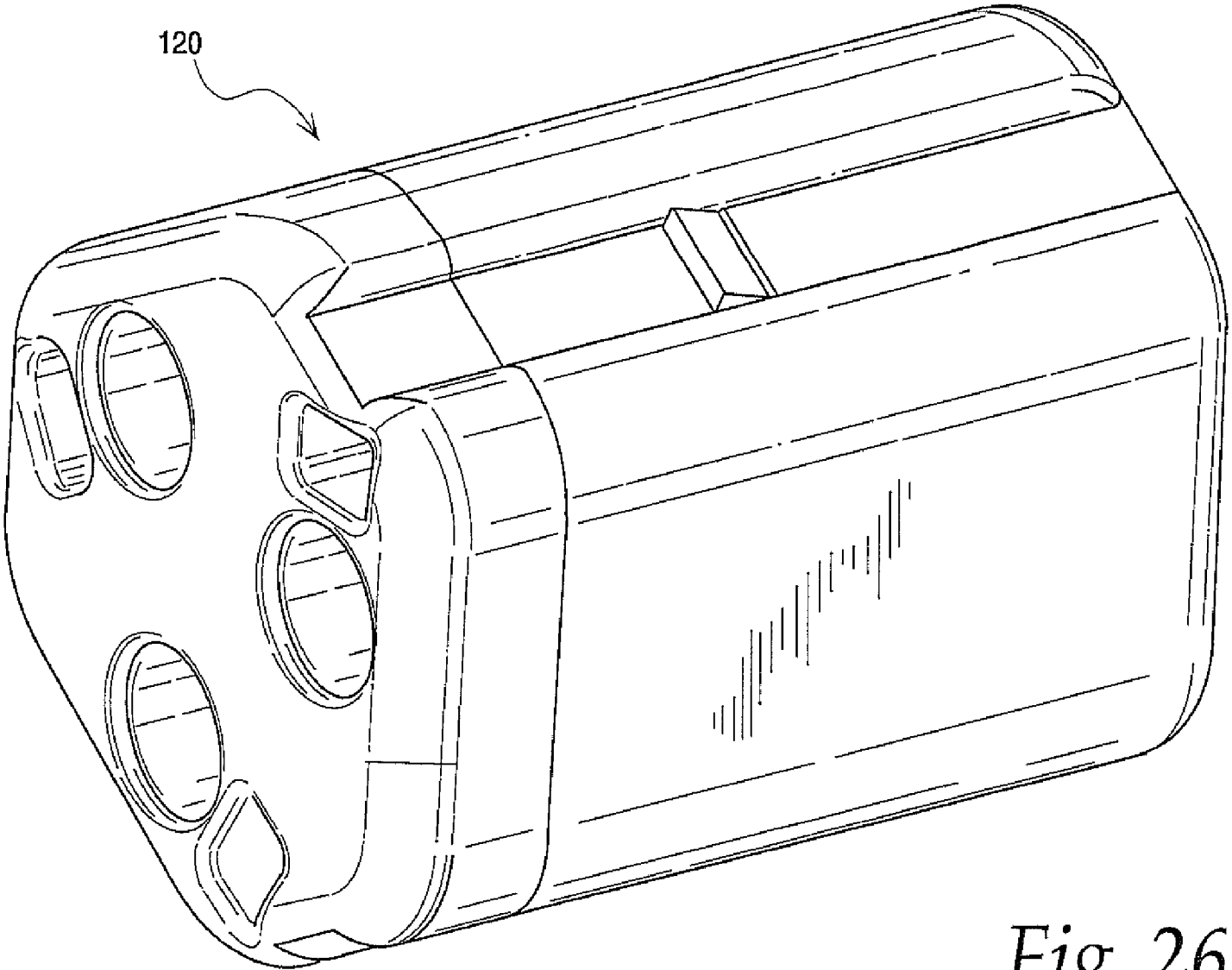
FIG. 26 is a perspective view a further alternate embodiment showing a 3-pole, 2-port in-line push-in connector.
Figure 27:
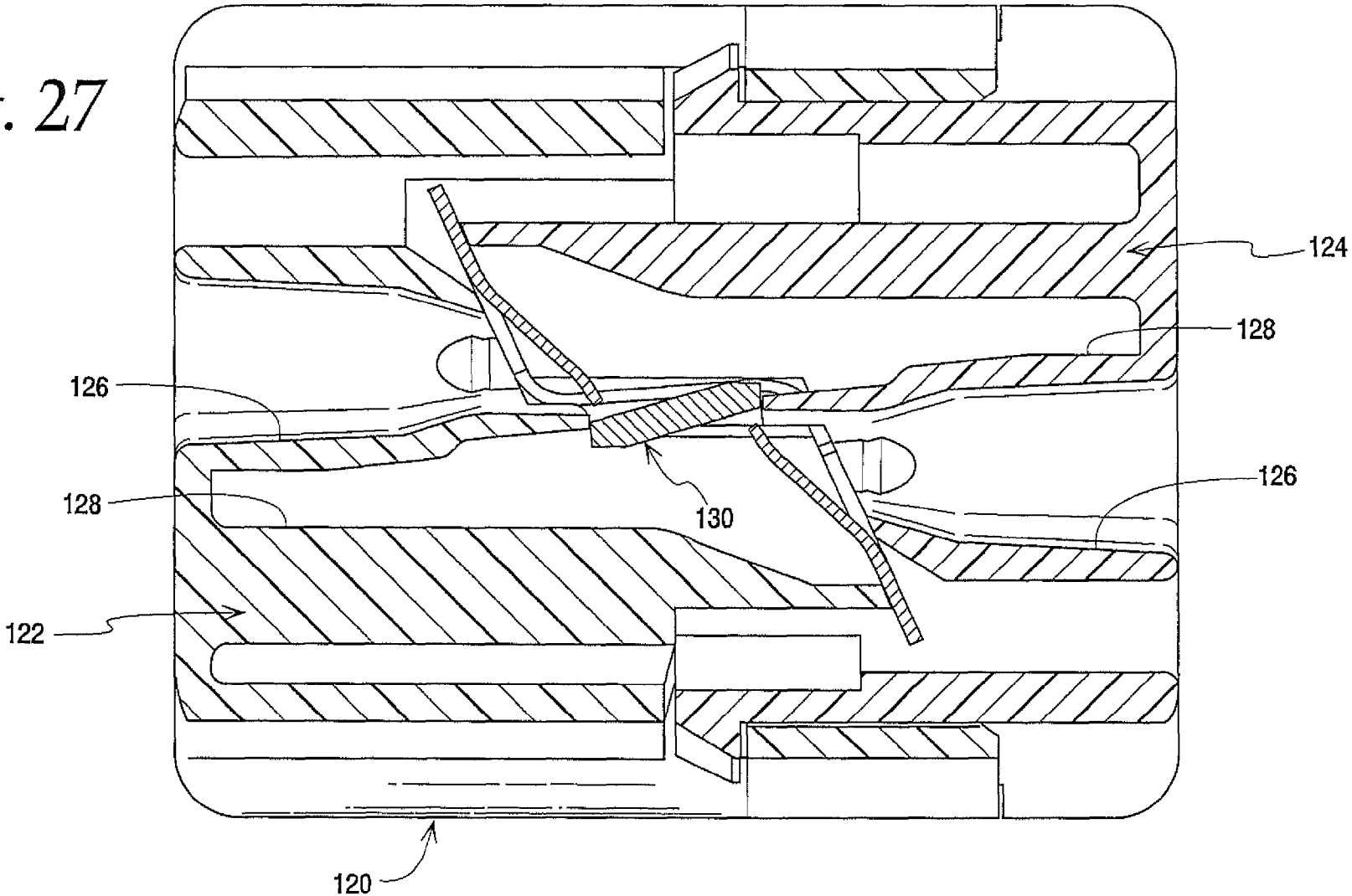
FIG. 27 is a section through one of the poles of the connector of FIG. 26.

FIGS. 26 and 27 illustrate a further alternate embodiment. This is a 3-pole, two-port in-line push-in connector 120. The construction of each pole is essentially similar to that of the FIG. 1 embodiment. Thus, there are left and right housings 122, 124. Each housing has a wire entry port 126 and a wire receptacle box 128 opposite the wire entry port of the other housing. The electrical terminal assembly 130 is largely the same as terminal assembly 84. Three separate terminal assemblies 130 are provided, each accommodating two wires. Thus, this connector makes separate connections between three pairs of wires. The poles are arcuately spaced 120° apart from one another in a plane transverse to the longitudinal axis. This arrangement allows the placement of three separate poles in a compact structure. Further details of this arcuate spacing are shown and described in U.S. patent application Ser. No. 11/774,858, filed Jul. 9, 2007, the disclosure of which is incorporated herein by reference.

Figure 28:
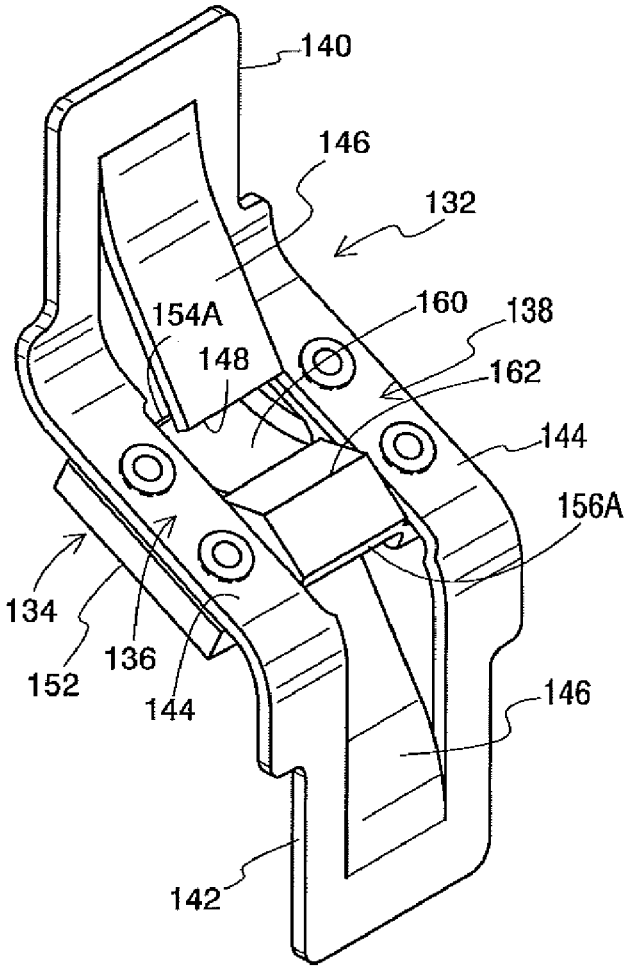
FIG. 28 is a perspective view of an alternate embodiment of a terminal assembly.
Figure 29:
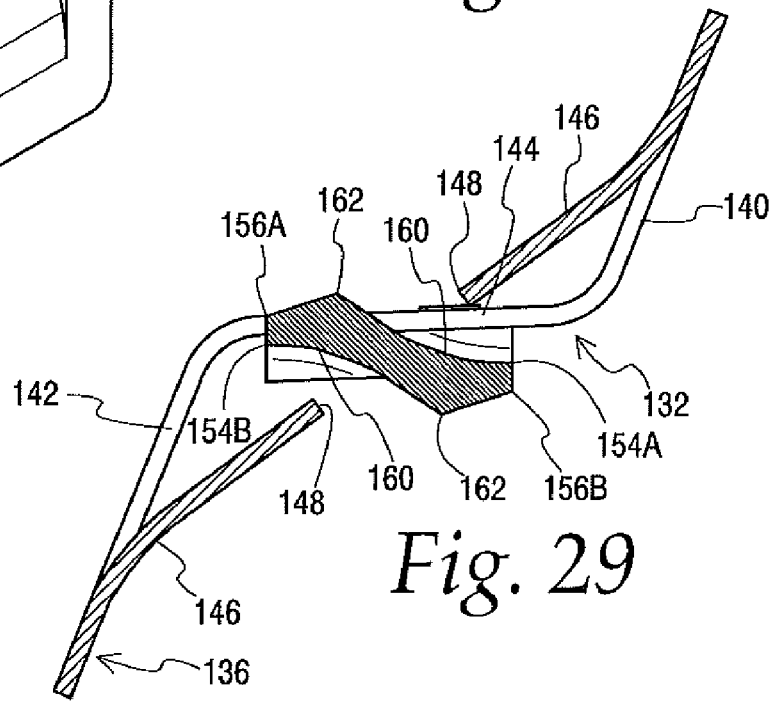
FIG. 29 is a section through the terminal assembly of FIG. 28, as generally indicated by the line 29-29 of FIG. 30.

FIGS. 28 and 29 illustrate an alternate embodiment of an electrical terminal assembly 132. This terminal assembly is largely similar to terminal assembly 84 but with some differences in the relationship between the busbar and the spring. Thus, terminal assembly 132 has a busbar 134 supported on a spring member 136. The spring member includes a foot 138 joined to an upstanding leg 140 and a depending leg 142. The foot has a pair of spaced bands 144. A U-shaped slit in each leg defines a spring finger 146. Each spring finger has a free end 148.

Figure 31:
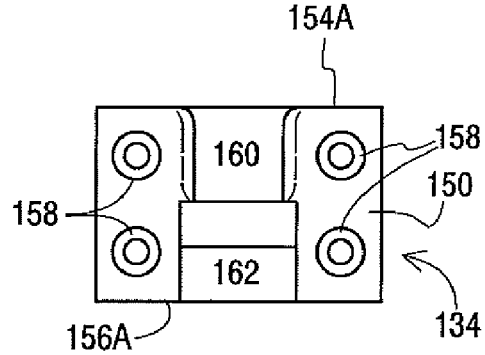
FIG. 31 is a top plan view of the busbar of the FIG. 28 terminal assembly.
Figure 30:
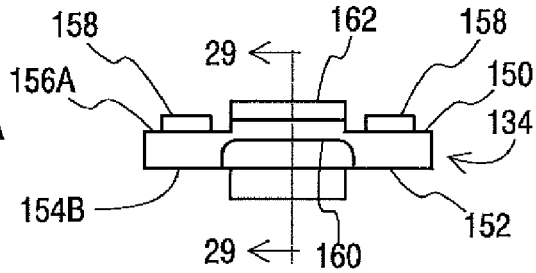
FIG. 30 is a side elevation view of the busbar of the FIG. 28 terminal assembly.

The busbar 134 has a top face 150 and a bottom face 152. As before, the terms 'top' and 'bottom' are used herein for reference purposes only. As seen in FIGS. 30 and 31, the top face 150 of the busbar 134 further defines an entry edge 154A, and an exit edge 156A. Again, the entry edge will be considered the edge of the busbar first crossed by a conductor entering the housing and the exit edge will be considered the edge of the busbar last crossed by an entering conductor. The bottom face 152 of the busbar 134 similarly defines an entry edge 154B, and an exit edge 156B. It will be noted that the entry edges 154A, 154B are on opposite edges of the busbar.

The busbar 134 is attached to the foot 138 of the spring member 136 by means of rivets 158 extending into apertures in the foot.

As shown in FIGS. 28-31, the busbar has a wire-receiving pocket 160 extending from each face. There is also a wire-engaging protrusion 162 extending from each face. The pockets 160 and protrusions 162 may be formed by coining the busbar, which creates a pocket on one face and a corresponding protrusion on the other face of the busbar. The pocket on one face is aligned with the protrusion on the other face, making the faces generally symmetrical.

Figure 33:
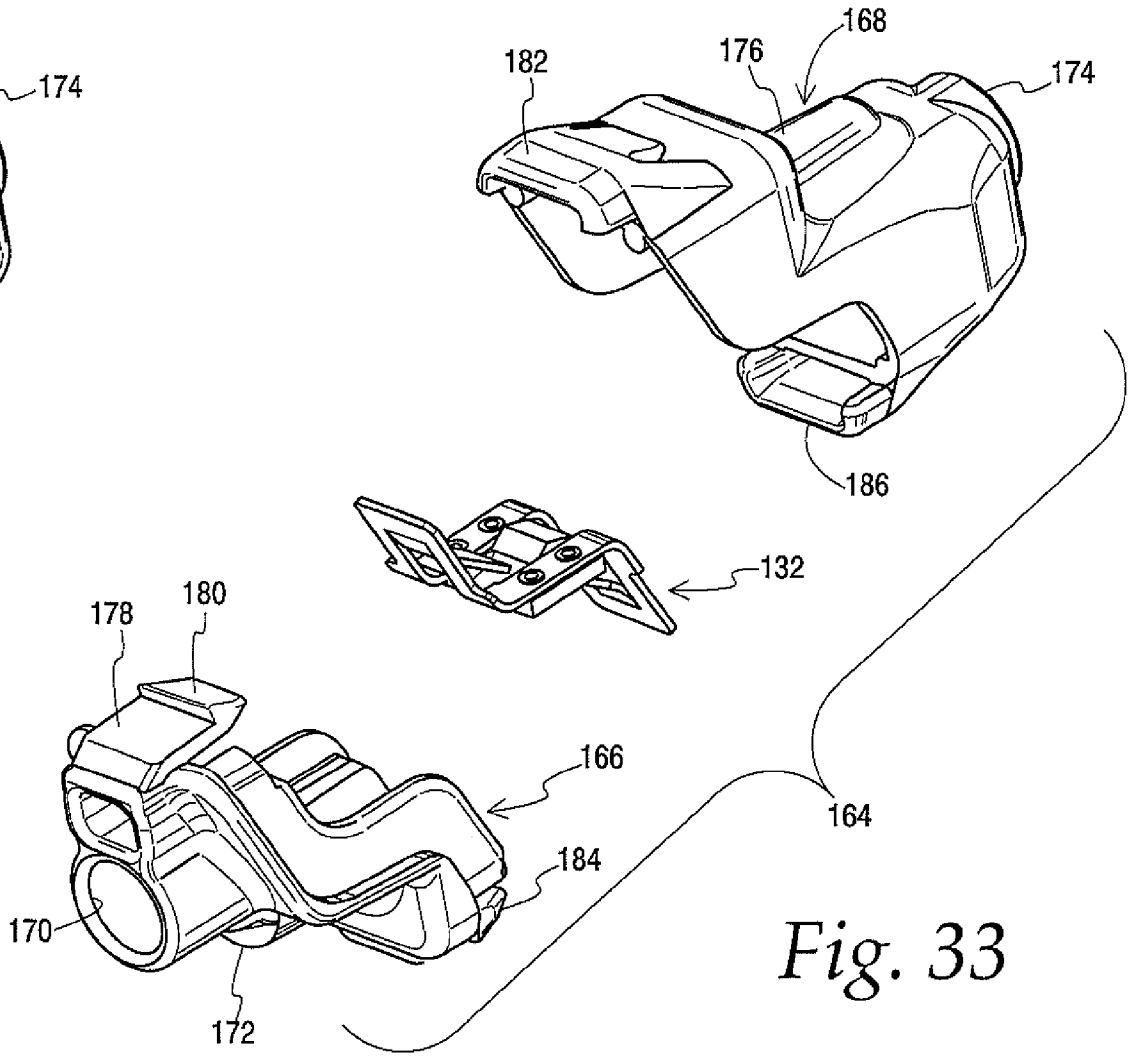
FIG. 33 is an exploded perspective view of the housing of FIG. 32.
Figure 32:
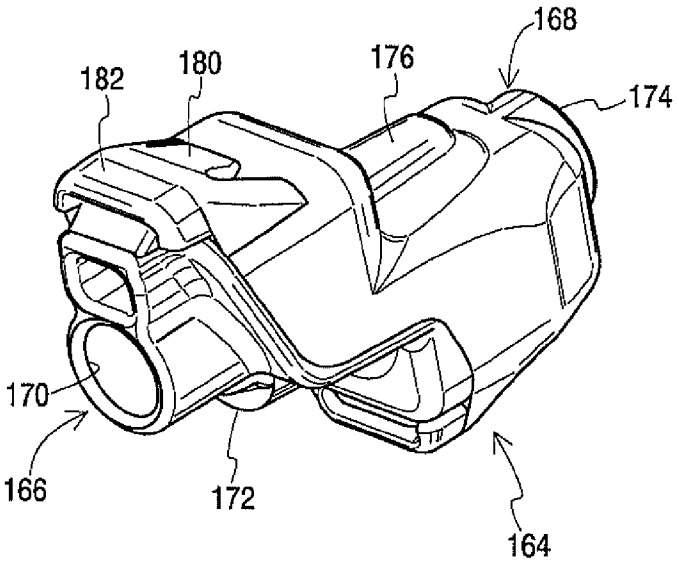
FIG. 32 is a perspective view of an alternate embodiment of a housing.

FIGS. 32 and 33 illustrate an alternate embodiment of the housing. This is a two-part, snap-fit housing 164 which is generally the same as FIGS. 1-19 but with a different latching arrangement. Thus, there are left and right housings 166, 168. Left housing 166 has a top wire entry port or opening 170 and a wire receptacle box 172. Right housing 168 has a bottom wire entry port 174 and a wire receptacle box 176 opposite the top wire entry port 170 of the other housing. The wire entry ports face in opposite directions. The electrical terminal 132 fits in the interior of the housing. The top of the left housing has a latch plate 178 with an upwardly facing hook 180. The plate fits through a catch 182 on the right housing such that the hook 180 is engageable with the catch to hold the housing pieces together. A similar latch plate 184 is near the bottom of the left housing where it is engageable with a catch 186 on the bottom of the right housing.

Figure 34:
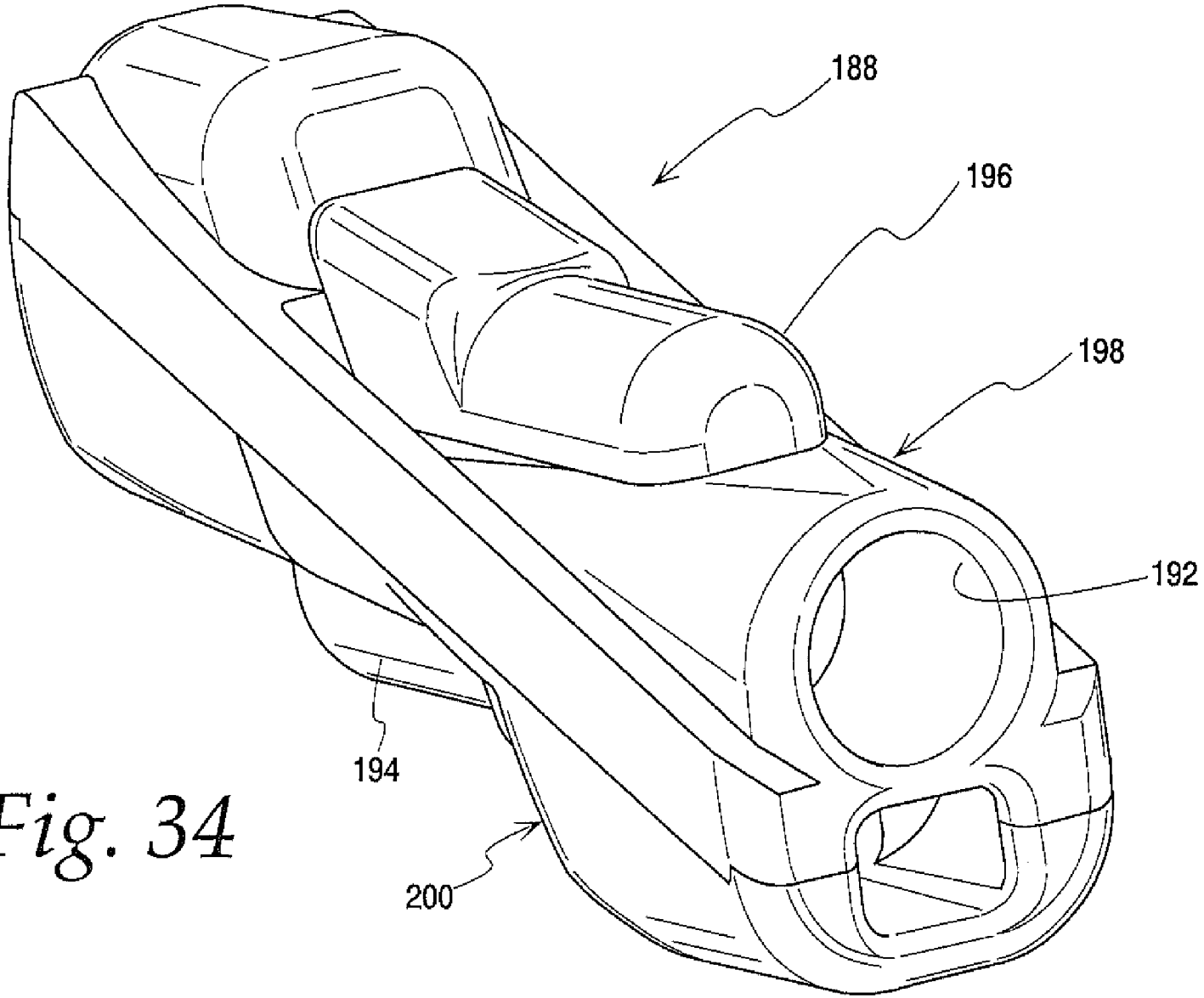
FIG. 34 is a perspective view of a further alternate embodiment of a housing.
Figure 35:
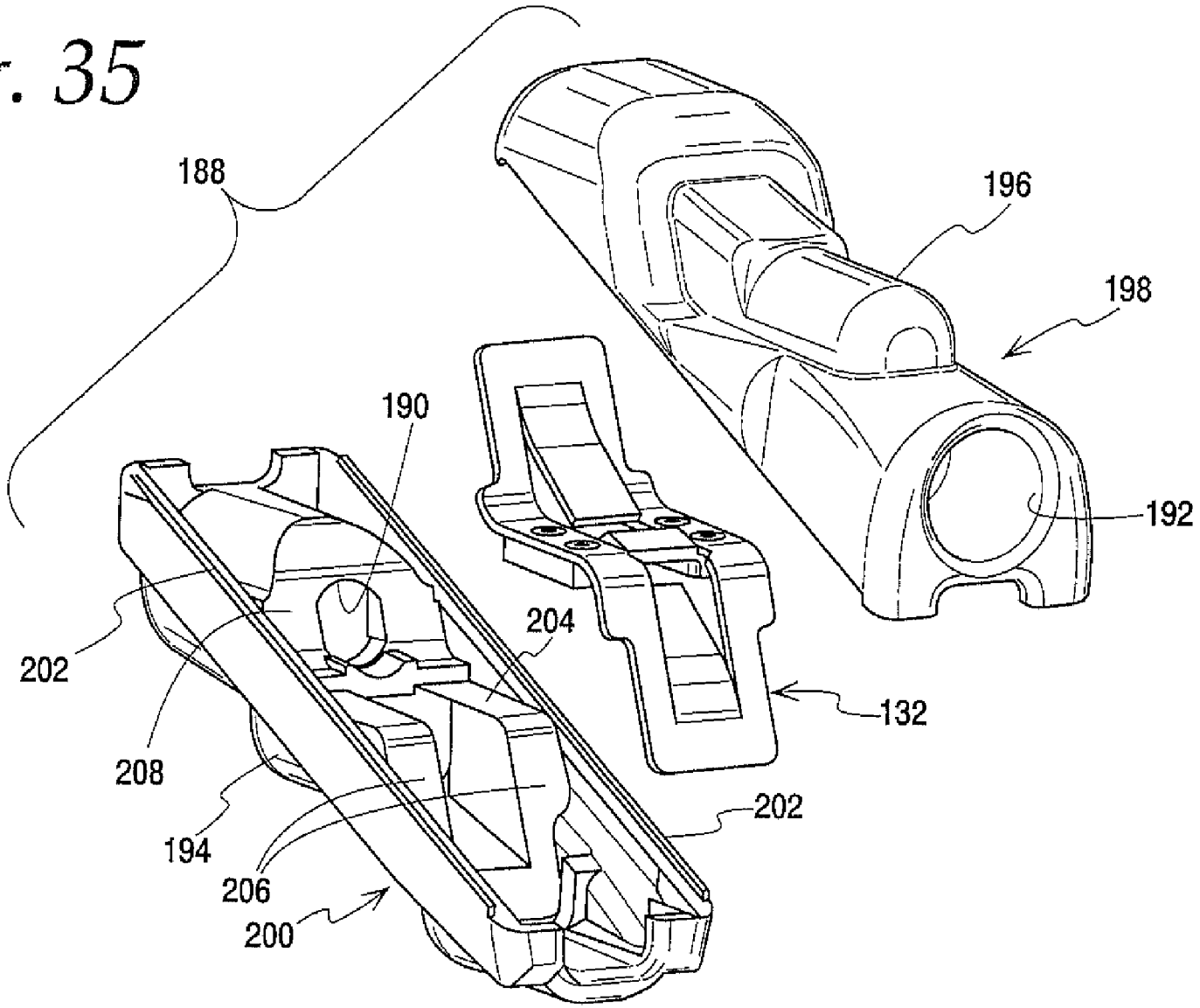
FIG. 35 is an exploded perspective view of the housing of FIG. 34.
Figure 36:
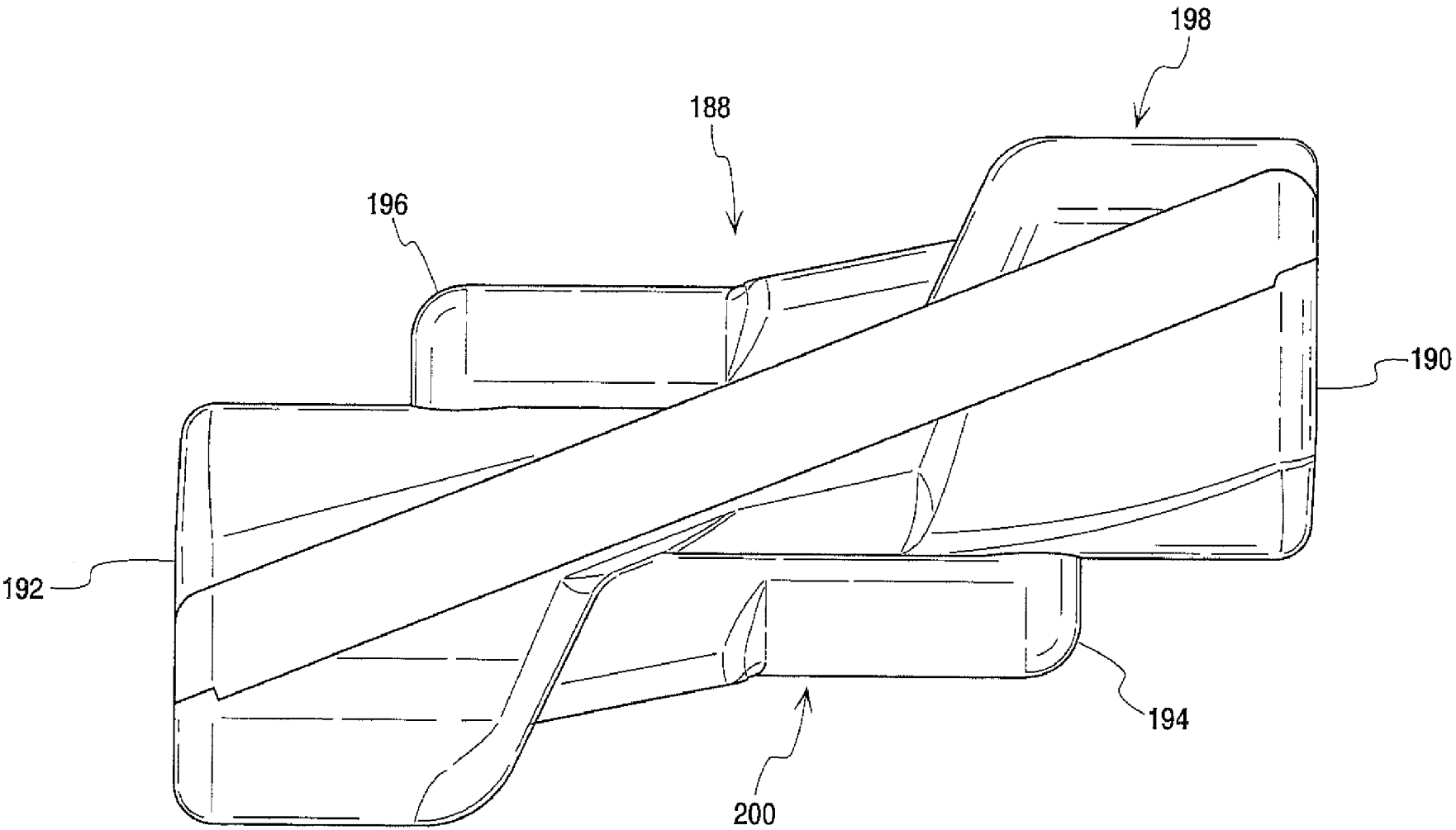
FIG. 36 is a side elevation view of the housing of FIG. 34.

A further alternate form of a housing is shown at 188 in FIGS. 34-36. This housing is also generally similar to that of FIGS. 1-19 with respect to the provision of top and bottom ports 190, 192 and wire receptacle boxes 194, 196. However, instead of the snap fit previously shown, housing 188 has upper and lower housing halves 198, 200 designed to be joined, such as by being ultrasonically welded along mating surfaces 202. This affords a particularly compact construction. The electrical terminal 132 fits in the interior of the housing. As seen in FIG. 35, the interior of the lower housing half has a seat 204 for supporting the busbar or foot portion of the terminal. Ledges 206 below the seat 204 support the depending leg 142 of the spring 136 while an upper wall 208 supports the upstanding leg 140. Similar surfaces in the upper housing 198 serve to trap the terminal in position.

Figure 37:
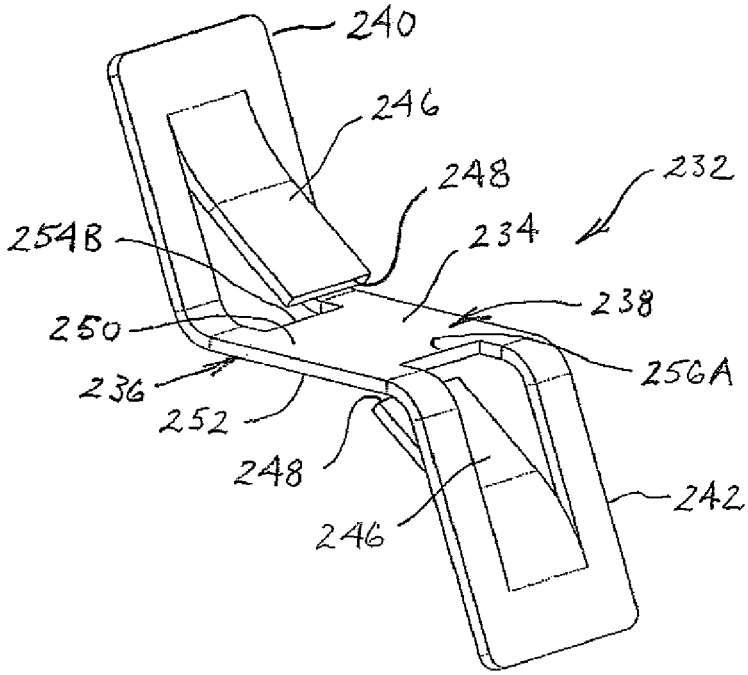
FIG. 37 is an upper perspective view of another alternate embodiment of a terminal assembly.
Figure 38:
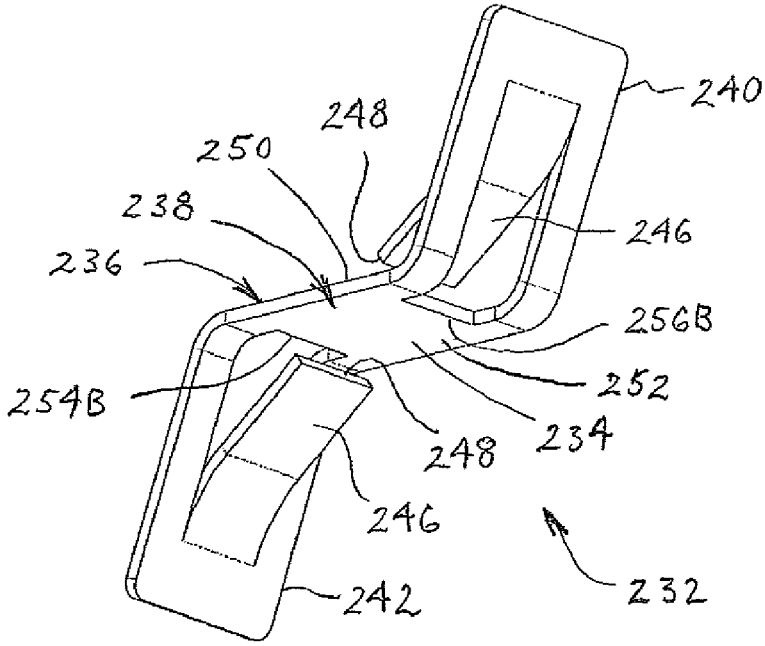
FIG. 38 is a lower perspective view of the terminal assembly of FIG. 37.

Turning to FIGS. 37 and 38, a further alternate embodiment of an electrical terminal assembly 232 is shown. This terminal assembly 232 is somewhat similar to terminal assembly 84 but with some differences in the relationship between the busbar and the spring member. In this instance, terminal assembly 232 has a busbar 234 that is integrally formed with a spring member 236. The spring member includes a foot 238 joined to an upstanding leg 240 and a depending leg 242.

The busbar 234 is integrally attached to or incorporated into the foot 238 of the spring member 236. In this example, the spring member 236 is preferably formed of a resilient metal such as a copper alloy or stainless steel. The material usage and gauge may depend on the intended size of the wires and the rated current. A U-shaped slit in each leg 240, 242 defines a spring finger 246, with each spring finger 246 having a free end 248.

The busbar 234 has a top face 250 and a bottom face 252. As before, the terms 'top' and 'bottom' are used herein for reference purposes only. As seen in FIGS. 37 and 38, the top face 250 of the busbar 234 further defines an entry edge 254A, and an exit edge 256A. Again, the entry edge will be considered the edge of the busbar first crossed by a conductor entering the housing and the exit edge will be considered the edge of the busbar last crossed by an entering conductor. The bottom face 252 of the busbar 234 similarly defines an entry edge 254B, and an exit edge 256B. It will be noted that the entry edges 254A, 254B are on opposite edges of the busbar.

Although not shown, the illustrated example in FIGS. 37 and 38 also may include a wire receiving pocket and wire engaging protrusion extending from each face of the busbar 234, as discussed above with respect to the embodiments in FIGS. 20-23 and FIGS. 28-31. As previously discussed, such pockets and protrusions may be formed by coining or pressing the busbar, creating a pocket on one face and a corresponding protrusion on the other face of the busbar. As in the other examples, if desired, the pocket may be formed on one face in alignment with the protrusion on the other face, making the faces generally symmetrical.

Figure 39:
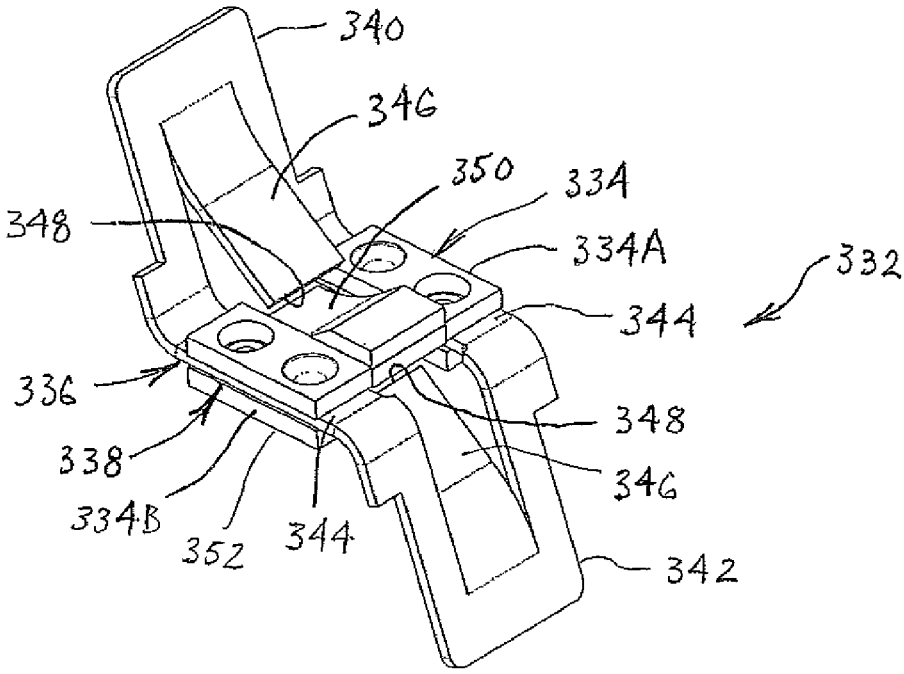
FIG. 39 is an upper perspective view of a further alternate embodiment of a terminal assembly.
Figure 40:
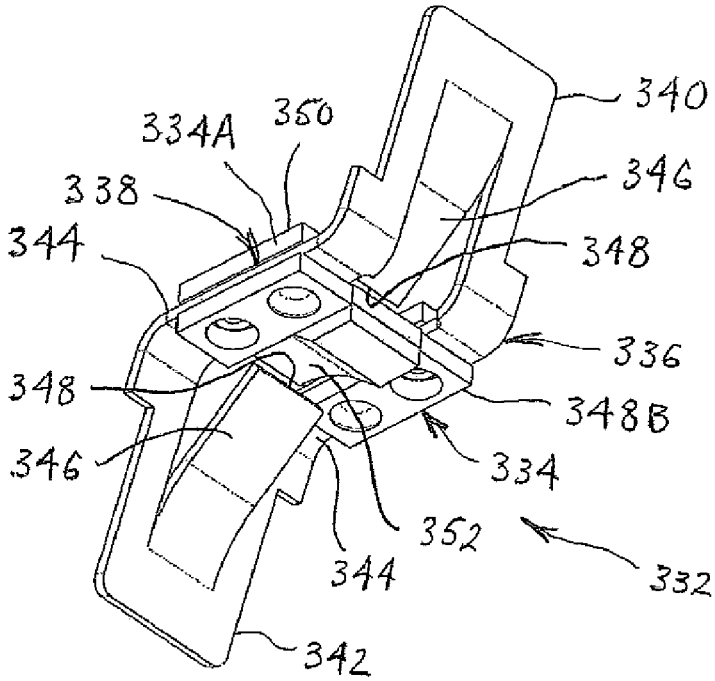
FIG. 40 is a lower perspective view of the terminal assembly of FIG. 39.

Yet another example of an alternate embodiment of an electrical terminal assembly 332 is illustrated in FIGS. 39 and 40. This further terminal assembly 332 is quite similar to terminal assembly 84 but with some differences in the relationship between the busbar and the spring member. In this example, terminal assembly 332 has a busbar 334 integrated with a spring member 336. The spring member 336 includes a foot 338 joined to an upstanding leg 340 and a depending leg 342.

Although not shown, the foot 338 has a pair of spaced bands 344, much like the foot 90 of the example shown in FIGS. 20-23 and the foot 138 of the example shown in FIGS. 28-31. However, it will be appreciated that the foot 338 also could be formed in a manner similar to the foot 238 of the example shown in FIGS. 37 and 38. In either construction, the busbar 334 is formed with top and bottom portions 334A and 334B of more conductive material attached adjacent the top and bottom faces, respectively, of the foot 338 of the spring member 336. A U-shaped slit in each leg 340, 342 defines a spring finger 346, and each spring finger 346 has a free end 348.

Given the layered or sandwich-type busbar configuration, the busbar 334 has a top face 350 provided by the top portion 334A and a bottom face 352 provided by the bottom portion 334B. As before the terms 'top' and 'bottom' are used herein for reference purposes only. As seen in FIGS. 39 and 40, the top face 350 of the busbar 334 further defines an entry edge 354A, and an exit edge 356A. As with the other examples, the entry edge will be considered the edge of the busbar first crossed by a conductor entering the housing and the exit edge will be considered the edge of the busbar last crossed by an entering conductor. The bottom face 352 of the busbar 334 similarly defines an entry edge 354B, and an exit edge 356B. It will be noted that the entry edges 354A, 354B are on opposite edges of the busbar.

Given this construction, the affixed busbar 334 becomes an integral part of the terminal assembly 332. In this example, the spring member 336 is preferably formed of a resilient metal such as stainless steel and the busbar portions 334A and 334B are constructed of tin-plated copper or other suitable metals. As with earlier examples, the busbar portions may be attached to the spring member 336 by means of rivets extending into apertures through the foot 338, or by other suitable means. In this example, it is important that the two busbar portions 334A and 334B actually establish a sound conductive relationship, whether by direct contact, molding in place, or via appropriate affixation to and contact with the intermediary material of the foot 338, such as by suitable fasteners.

As discussed above with respect to the other example terminal assemblies, the illustrated example in FIGS. 39 and 40 also may include a wire receiving pocket and wire engaging protrusion extending from each face of the busbar 334. As noted, such pockets and protrusions may be formed by suitable methods, such as molding, or coining or pressing the busbar, creating a pocket on one face and a corresponding protrusion on the other face of the busbar. As in the other examples, if desired, the pocket may be formed on one face in alignment with the protrusion on the other face, making the faces generally symmetrical. In the particular illustrated example of FIGS. 39 and 40, each busbar portion 334A and 334B includes a contoured central section that establishes the entry for a conductor at the entry edge 354A and 354B respectively, and which leads into a ramp that terminates in a protrusion 362, to assist in establishing good contact with the conductor end of an inserted wire. In this manner, as with the prior examples, when each respective conductor is forced through a port and into contact with a spring finger 346 and a busbar portion 334A, 334B, the spring finger 346 of the spring member 336 is displace to allow entry of the conductor, but in turn forces the conductor into engagement with the busbar 334 and anchors the conductor within the connector as the free end 348 of the respective spring finger 346 resists rearward motion or pull out of the wire.

We claim:

1. A push-in wire connector, comprising:

an enclosure including a hollow interior and at least first and second wire ports, each of the first and second wire ports including a longitudinal axis and providing access to the interior for the ends of wires inserted into the first and second wire ports, the first and second wire ports facing in opposite directions with the respective axes of the first and second wire ports being spaced apart from one another;

a busbar being engageable with wires inserted into the first and second wires ports, the busbar being disposed within the interior of the enclosure and wherein the busbar is adapted to passively receive a load applied to each respective wire;

a spring member disposed within the interior of the enclosure and configured to bias a first wire end inserted through the first wire port into engagement with the busbar and to bias a second wire end inserted through the second wire port into engagement with the busbar;

and wherein the busbar and spring member are integrated into a terminal assembly.

2. The push-in wire connector of claim 1 wherein the integrated terminal assembly is made from a plurality of materials.

3. The push-in wire connector of claim 1 wherein the integrated terminal assembly is made from one material.

4. The push-in wire connector of claim 1 further including a first spring finger to bias the first wire end and a second spring finger to bias the second wire end.

5. The push-in wire connector of claim 1 wherein the busbar is positioned within the enclosure for engagement along at least one side of each wire.

6. The push-in wire connector of claim 1 wherein the busbar permits each of the respective inserted wires to extend beyond the busbar in both of the opposite directions.

7. The push-in wire connector of claim 1 wherein the enclosure comprises at least two housing portions and each housing portion includes at least one wire receptacle box and at least one of the wire ports.

8. The push-in wire connector of claim 1 in which the busbar has top and bottom faces that each include a wire-engaging protrusion.

9. A terminal assembly for use in a push-in wire connector, comprising:

a spring member having a foot;

the foot having opposed first and second end portions and top and bottom faces, a first leg extending from the first end portion of the foot in a first direction and a second leg extending from the second end portion of the foot in a second direction, with each of the first and second legs including a spring finger;

a busbar integrated with the foot; and the first spring finger adapted to bias a first wire end into engagement with the busbar, and the second spring finger adapted to bias a second wire end into engagement with the busbar.

10. The terminal assembly of claim 9 wherein the spring member and busbar of the integrated terminal assembly are made from a plurality of materials.

11. The terminal assembly of claim 10 wherein the busbar is made from at least one material and is attached to the foot of the spring member which is made from at least one material that is different from the at least one material of the busbar.

12. The terminal assembly of claim 11 wherein the busbar includes a top face and a bottom face.

13. The terminal assembly of claim 12 wherein the busbar includes a top portion attached to the top face of the foot and a bottom portion attached to the bottom face of the foot.

14. The terminal assembly of claim 9 wherein the spring member and busbar of the integrated terminal assembly are made from the same material.

15. The terminal assembly of claim 14 wherein the spring member and busbar of the integrated terminal assembly are formed as a unitary piece.

16. The terminal assembly of claim 9 wherein at least one of the busbar top face and bottom face includes a wire-engaging protrusion.

17. A push-in wire connector, comprising:

an enclosure having at least two ports facing in opposite directions, the ports each defining an axis and providing access to an interior of the enclosure for the ends of wires inserted into the enclosure, the respective axes of the ports being spaced apart;

a busbar disposed within the interior of the enclosure, the busbar defining a first entry edge where a wire inserted into one of the ports first crosses the first entry edge of the busbar, and the busbar defining a second entry edge where a wire inserted into a second of the ports first crosses the second entry edge of the busbar, the first and second entry edges being on opposite sides of the busbar; and a spring member disposed within the interior of the enclosure and having a first upstanding leg adjacent the first entry edge and a second upstanding leg adjacent the second entry edge, each upstanding leg including a spring finger engageable with a wire inserted into a respective port to bias the wire into engagement with the busbar; and wherein the busbar and spring member are integrated into a terminal assembly.

18. The push-in wire connector of claim 17 wherein the integrated terminal assembly is made from a plurality of materials.

19. The push-in wire connector of claim 17 wherein the integrated terminal assembly is made from one material.

20. The push-in wire connector of claim 17 wherein the busbar and spring member of the integrated terminal assembly are formed as a unitary piece.

21. The push-in wire connector of claim 17 wherein the busbar comprises at least two separate portions connected to the spring member.

22. A push-in wire connector, comprising:

an enclosure including a hollow interior and at least first and second wire ports, each of the first and second wire ports including a longitudinal axis and providing access to the interior for the ends of wires inserted into the first and second wire ports, the first and second wire ports facing in opposite directions with the respective axes of the first and second wire ports being spaced apart from one another; and a busbar being engageable with wires inserted into the first and second wire ports, the busbar being disposed within the interior of the enclosure and wherein the busbar is adapted to passively receive a load applied to each respective wire.

23. The push-in wire connector of claim 22 further including a first spring member disposed within the interior of the enclosure and configured to bias a first wire end inserted through the first wire port into engagement with the busbar, and a second spring member disposed within the interior of the enclosure and configured to bias a second wire end inserted through the second wire port into engagement with the busbar.

24. A terminal assembly for use in a push-in wire connector, comprising:

a foot having opposed first and second end portions and top and bottom surfaces, a first upstanding leg extending from the first end portion of the foot in a first direction and a second upstanding leg extending from the second end portion of the foot in a second direction generally opposite the first direction, each of the first and second legs including a spring member;

a busbar connected to one of the top and bottom surfaces of the foot, the busbar including a top face and a bottom face; and the first spring member adapted to bias a first wire end into engagement with the top face of the busbar, and the second spring member adapted to bias a second wire end into engagement with the bottom face of the busbar.

* * * * *